United States Patent [19]

Redford

[11] 4,026,357

[45] May 31, 1977

[54] IN SITU GASIFICATION OF SOLID HYDROCARBON MATERIALS IN A SUBTERRANEAN FORMATION

[75] Inventor: David A. Redford, Fort Saskatchewan, Canada

[73] Assignee: Texaco Exploration Canada Ltd., Calgary, Canada

[22] Filed: June 26, 1974

[21] Appl. No.: 483,172

[52] U.S. Cl. ..... 166/261; 166/267

[51] Int. Cl.[2] ..... E21 43/24

[58] Field of Search ..... 166/260, 261, 266, 267, 166/272

[56] References Cited

UNITED STATES PATENTS

| | | | |
|---|---|---|---|
| 2,584,605 | 2/1952 | Merriam et al. | 166/266 |
| 2,695,163 | 11/1954 | Pearce et al. | 166/266 |
| 2,825,408 | 3/1958 | Watson | 166/272 |
| 2,839,141 | 7/1958 | Walter | 166/261 |
| 2,906,337 | 9/1959 | Hennig | 166/266 |
| 3,044,545 | 7/1962 | Tooke | 166/260 |
| 3,145,772 | 8/1964 | Huitt | 166/261 |
| 3,174,543 | 3/1965 | Sharp | 166/261 |
| 3,205,944 | 9/1965 | Walton | 166/261 |
| 3,344,856 | 10/1967 | Lange | 166/261 |
| 3,360,044 | 12/1967 | Lange | 166/272 |
| 3,442,332 | 5/1969 | Keith | 166/267 |
| 3,480,082 | 11/1969 | Gilliland | 166/272 |
| 3,605,890 | 9/1971 | Holm | 166/261 |
| 3,766,982 | 10/1973 | Justheim | 166/272 |
| 3,830,300 | 8/1974 | Allen | 166/261 |

*Primary Examiner*—Ernest R. Purser

*Attorney, Agent, or Firm*—Thomas H. Whaley; Carl G. Ries; Jack H. Park

[57] ABSTRACT

Solid hydrocarbon materials present in subsurface earth formation such as, for example, the coke like residue remaining in a subterranean tar sand deposit which has previously been exploited by controlled oxidation depletion, is converted to a synthesis gas composition by contacting the solid hydrocarbon material with an oxygen enriched gas or essentially pure oxygen and a moderating fluid such as water, steam or carbon dioxide to control the reaction temperature so as to ensure the generation of carbon monoxide and hydrogen within the formation. The oxygen and steam or carbon dioxide may be injected as a mixture or simultaneously by separate injection means, or oxygen may be injected for intervals of time interrupted by brief periods of carbon dioxide, steam or water injection. The effluent is predominantly gaseous carbon monoxide, hydrogen, and lesser amounts of carbon dioxide and methane and, occasionally liquid hydrocarbons. The mixture of carbon monoxide and hydrogen may be utilized directly as a fuel gas, or may be utilized as feed stock for petro chemical manufacturing processes. Carbon dioxide may be separated from the effluent gaseous mixture and recycled with steam into the formation.

16 Claims, 1 Drawing Figure

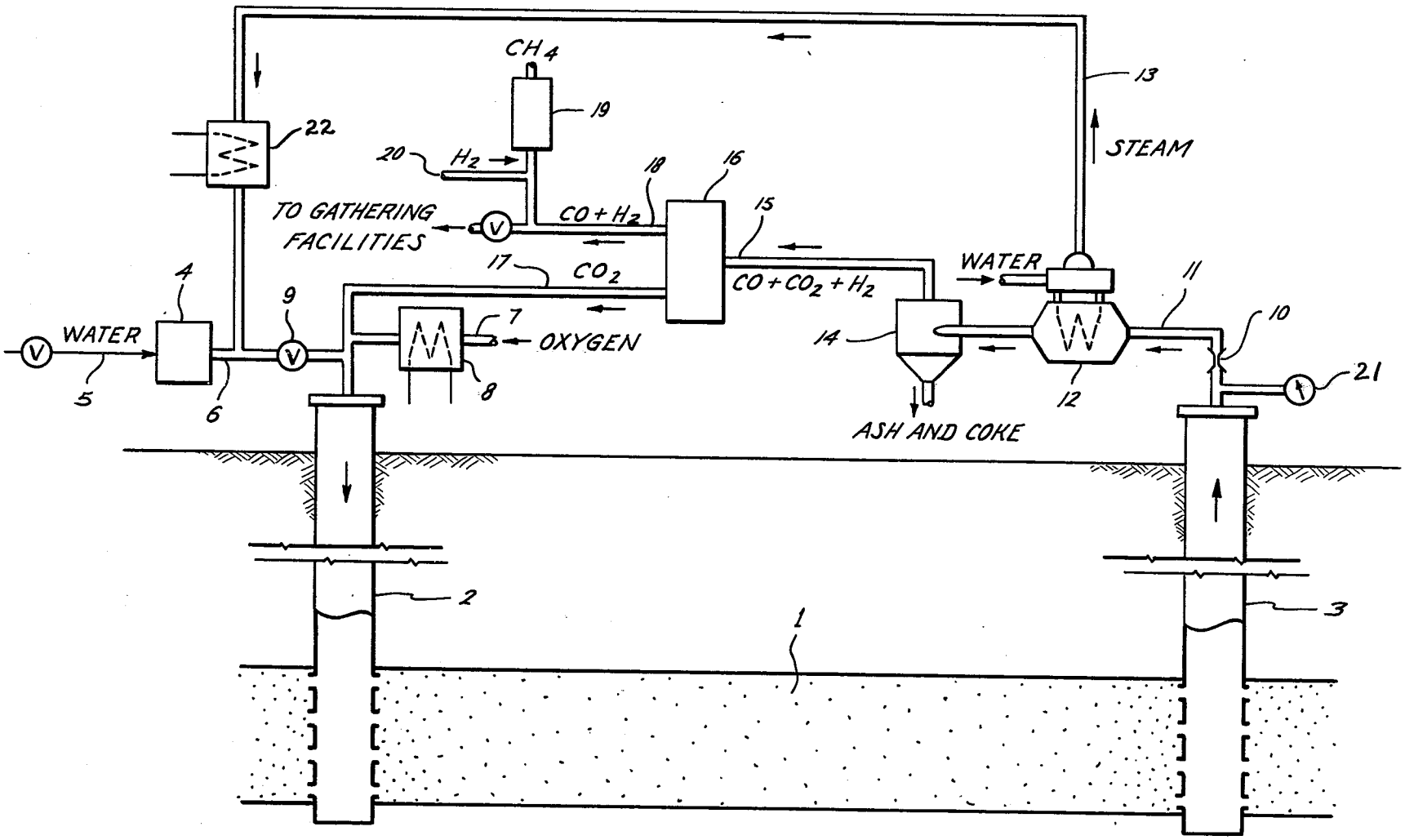
STEAM
WATER
ASH AND COKE
$CO + CO_2 + H_2$
$CO + H_2$
$CO_2$
OXYGEN
$CH_4$
$H_2$
TO GATHERING FACILITIES
WATER
1
2
3
4
5
6
7
8
9
10
11
12
13
14
15
16
17
18
19
20
21
22

IN SITU GASIFICATION OF SOLID HYDROCARBON MATERIALS IN A SUBTERRANEAN FORMATION

BACKGROUND OF THE INVENTION

1. Field of the Invention

This invention concerns a process for converting solid hydrocarbon materials present in a subterranean formation into a gaseous material which can be recovered from the formation and utilized for fuel or other purposes.

2. Description of the Prior Art

Many subterranean, hydrocarbon containing deposits are not amenable to the recovery of the hydrocarbon materials by primary recovery because the hydrocarbon materials are too viscous to flow even if a pressure differential is applied to the material and the materials are present in a permeable formation. For example, tar sand deposits as are found in the western part of the United States and in the northern part of Alberta, Canada contain vast quantities of bituminous petroleum, but essentially no material may be recovered by so called primary means because the viscosity of the bituminous petroleum at reservoir conditions is in the range of millions of centipoise. Accordingly, some form of supplemental recovery process must be applied to these tar sand materials, as well as to other subterranean, viscous petroleum containing formations, in order to recover any appreciable amount of hydrocarbon fluids therefrom.

In the case of the tar sand deposits, a particularly promising supplemental recovery technique has been disclosed in copending application, Ser. No. 481,581 filed June 21, 1974 and in Ser. No. 481,582 filed June 21, 1974, which generally involves the use of critical ratio of air and steam to achieve a controlled low temperature oxidation reaction which propagates rapidly throughout the tar sand material, mobilizing an appreciable quantity of viscous petroleum present in the formation, and results in recovering up to about 75 percent of the petroleum in place. This recovery technique is different from the conventional in situ combustion process and more successful when applied to formations similar to the tar sand deposits, because the permeabiliy of the tar sand deposit is too low to permit application thereto of conventional in situ combustion as is practiced in more conventional oil reservoirs. Although this process results in an unusually high percentage recovery as compared to other supplemental recovery processes for use in tar sand deposits, a carbon residue does remain on the sand grains in the formation after termination of a controlled oxidation reaction.

It is known by persons skilled in the art, and amply described in the literature, that many viscous liquid hydrocarbon materials, and under certain conditions granulated solid hydrocarbon materials, may be converted to a synthesis gas by subjecting the hydrocarbon materials to steam and oxygen under controlled conditions in a suitably fabricated reactor. For example, the following U.S. Patents deal with various aspects of gasification of liquid or solid carbonaceous materials in surface reactors under conditions of high temperature and pressure. U.S. Pat. No. 2,864,677, Eastman, et al.; U.S. Pat. No. 2,976,134, Paull; U.S. Pat. No. 2,992,907, Atwell; U.S. Pat. No. 3,097,081, Eastman, et al.; U.S. Pat. No. 3,556,751, Slater, et al.; and U.S. Pat. No. 3,709,669, Marion, et al. All of these patents deal with methods whereby synthesis gas, specifically carbon monoxide and hydrogen, may be produced from solid or viscous liquid hydrocarbon materials in a high pressure, high temperature reactor by reaction with steam and oxygen.

In those instances where some portion of the lower molecular weight hydrocarbons have been recovered from subsurface deposits such as from tar sand deposits, the percentage of hydrocarbon materials remaining is too small to justify mining operations, although the total amount of hydrocarbon present in these formations is considerable because of their volumes there is a substantial need for a method which will permit recovery and utilization of hydrocarbon materials present in subsurface formations. There is particularly a need for a method which will permit recovery of essentially solid and otherwise unrecoverable hydrocarbon materials by converting the solid materials into a gaseous form within the reservoir itself, and recovering the gaseous form materials from the formation where they may be utilized as fuel or feed gas for manufacturing operations.

SUMMARY OF THE INVENTION

Solid hydrocarbon materials contained in a subsurface, porous, permeable formation may be converted to a gaseous form and thereby transported to the surface, by contacting the material with a gas which is at least 40 percent oxygen, in combination with a moderating fluid such as steam or carbon dioxide to convert the carbonaceous material to carbon monoxide and hydrogen. In a preferred embodiment, essentially pure oxygen is injected into the formation and sufficient heat is applied to the formation at the point of oxygen injection to initiate an in situ combustion reaction, after which the extraneous heat source is removed and oxygen injection is continued to propagate a high temperature reaction zone within the formation. A moderating fluid is then injected simultaneously or intermittently with the oxygen, the moderating fluid being steam, water or carbon dioxide. The moderating fluid serves to reduce the oxidation reaction temperature, and consequently ensure that the predominant product of the reaction is carbon monoxide and hydrogen. The weight ratio of oxygen to steam is thereafter maintained at a value between 0.2 and 3.0. Some thermal cracking of the hydrocarbon material will result in the production of small amounts of low molecular weight hydrocarbons which may be either gaseous or a liquid, but a substantial portion of the solid hydrocarbon material will be converted to carbon monoxide and hydrogen. Carbon monoxide and hydrogen are produced from a spaced apart production well and subjected on the surface to additional treatment as necessary, depending on the use to be made of the produced gaseous materials.

BRIEF DESCRIPTION OF THE DRAWING

The attached drawing depicts a subterranean hydrocarbon containing formation being subjected to the process of my invention, with surface treating facilities for further processing of the produced gases.

DESCRIPTION OF THE PREFERRED EMBODIMENTS

Briefly, this invention concerns a method for converting solid hydrocarbon materials contained in subterranean, porous, permeable formation, which materials are unrecoverable in their current form by known supplemental recovery techniques, to a predominantly gaseous form by means of which the carbon materials may be transported to the surface and used as a fuel or feed stocks for manufacturing operations. One particularly attractive embodiment of this invention involves treating a subterranean tar sand deposit which has previously been exploited by a controlled oxidation reaction of the type wherein air and steam are injected into the formation for the purpose of propagating a low temperature, controlled oxidation reaction through the formation, whereby a substantial portion of the bituminous petroleum material present in the tar sand deposit may be recovered. Although the process results in an unusually high total recovery efficiency, the residual saturation of the formation is found to be about 3.2 percent hydrocarbons, of which 1.6 percent is soluble in hot toluene and the remaining 1.6 percent, predominantly carbon residue, is not soluble in hot toluene. The permeability of the depleted tar sand deposit is quite high, as contrasted to the original very low permeability that existed in the tar sand deposit prior to the controlled oxidation recovery program. The hydrocarbon material remaining in the formation is principally in the form of a thin film distributed somewhat evenly throughout the formation, all of the sand grains being fairly uniformly coated. Although the weight percent of hydrocarbon residue is only about 3.2 percent, it should be realized that this still amounts to approximately 5 pounds of hydrocarbon material per cubic foot of formation. The commercial significance of this is considerable when compared to the volume of tar sand material that might be encountered in an ordinary section of a reservoir. For example, in a 5,000 acre segment in which there is a tar sand deposit 100 feet thick, there is 105 billion pounds of hydrocarbon material remaining in the formation after completion of the first phase oil recovery process employing controlled oxidation.

The process of my invention may be best understood by referring to the attached drawing, in which tar sand deposit 1 is penetrated by injection well 2 and production well 3, both wells being completed throughout the entire thickness of the tar sand deposit. The tar sand deposit has previously been exploited by controlled oxidation, and their remains deposited on the sand grains within these deposits a thin film of carbon residue as described above. A steam generator 4 supplied by boiler feed quality water 5 has its output 6 connected to injection well 2. An air fractionation plant (not shown) produces approximately 98 percent pure oxygen which flows through line 7 and through heater 8 into injection well 2. The temperature of the essentially pure oxygen is raised to the highest level thought to be safe, which is normally around 600° F. to 800° F. Initially valve 9 is closed and essentially pure oxygen is injected into injection well 2, and an electric heater (not shown) is positioned in injection well 2 adjacent the perforations establishing communication with the tar sand deposit 1. The heater is a 20,000 kilowatt electric heater capable of heating a portion of the formation immediately adjacent to the injection well to a temperature of about 1100° F. with oxygen flowing into the well, which results in the ignition of the carbon residue on the sand grains in tar sand deposit 1. The heater is utilized for only the first 34 hours of operation, and is thereafter removed from the well. Valve 9 is opened and steam is mixed with the heated oxygen from heater 8 and the hot mixture is introduced into the formation. Initially the ratio of oxygen to steam is 3 or more (3 pounds of oxygen per pound of steam), and this ratio is decreased or tapered gradually with time until a value about 1 is achieved after a period of approximately 10 days. This ensures that the oxidation reaction will continue so as to provide the necessary heat for the partial oxidation reaction to occur.

Oxygen and steam react in the formation with the carbon residue to generate carbon monoxide and hydrogen according to the following equation:

$$C_x H_y + (y/2)O_2 \rightarrow \times CO + (y/2)H_2$$

The above disregards any sulfur present in the hydrocarbon residue, and to the extent any sulfur is present, hydrogen sulfide will be produced and the amount of hydrogen generated will be reduced. The above described partial oxidation reaction is exothermic, and produces sufficient heat to ensure that the reaction is self sustaining. The reaction continues at the autogenous temperature resulting from the exothermic partial oxidation reaction.

Although the desired or optimum temperatures for conducting the above described reaction in a surface reactor is around 1500° to 2500° F., the reaction occurs spontaneously in the formation without the need for controlling the temperature because of the dramatically longer dwell time that the reactants have in the subterranean formation as compared to a reactor on the surface. The typical dwell times for a partial oxidation reactor on the surface may range from 1 to 3 seconds, whereas the reactants are present together in the formation for much longer periods of time in application of the present process.

Because of the heat generated by the above described reaction, the temperatures present within the formation are adequate to accomplish some in situ thermal cracking of the hydrocarbon residue, particularly that portion of the residue described above which is soluble in hot toluene. The cracking reaction precedes according to the following equation:

$$C_x - H_y \rightarrow (x/4)CH_4 + [y - (x/4)]\ C$$

It can be seen that some coke is produced simultaneously with any production of methane or higher molecular weight gaseous or liquid hydrocarbons. The coke produced as a result of the thermal cracking reaction described above may be present either in the form of an additional carbon residue deposited on the sand grain, which will be reacted in the partial oxidation reaction, or a fine powdery carbon black-like material is sometimes produced. The material will not cause any particular problem in application of this process as described herein, since the permeability of the tar sand deposit after depletion by controlled oxidation is adequate to allow a certain amount of deposition of fine grain coke without any danger of plugging the flow channels. This would not be true if the process were applied to a virgin tar sand deposit which had not been previously depleted to some extent by the low temperature oxidation reaction.

Carbon monoxide and hydrogen are the principal effluents from production well 3, although some methane is produced and some liquid hydrocarbons may be produced as well. In order to ensure that the pressure remaining within the formation is high enough to sustain the partial oxidation reaction, it is usually necessary to provide a choke device 10 which restricts flow of effluent gases from the production well, thereby maintaining the pressure within the formation at a value of at least several hundred pounds per square inch. This is monitored in the embodiment illustrated in the figure by gauge 21 which reads the pressure down stream from the choke 10. The restriction device is necessary because the permeability of a partially depleted tar sand deposit is so high that essentially no pressure differential would be developed as a consequence of the resistance to flow within the formation. The gaseous effluents pass through line 11 into heat exchanger 12. The temperature of the gaseous effluents is quite high, in the order of 500° or 600° F., and so it is desirable to recover a substantial portion of this heat for use in the process. Once the temperature of the gaseous effluent has risen to a value of above about 300° F., generation of at least a portion of the steam used in the process may be accomplished by this heat scavenging means. Steam generation is accomplished by passing boiler feed quality water into heat exchanger 12, the heat being removed from the gaseous effluents and utilized to generate steam which is transported via line 13 back through superheater 22 to the injection well. The cooled effluents are then passed into a mechanical separator 14 which may be a cyclone type of centrifugal separator or an electrostatic precipitator to remove the particulate matter such as ash and coke from the effluent stream. The produced gas then passes through line 15 to a carbon dioxide scrubber 16. Carbon dioxide may be scrubbed from the produced gas by absorption in water, methanol, monoethanolamine, or with a light hydrocarbon. Amine scrubbing is an especially effective and preferred method of removing the carbon dioxide. Carbon dioxide removal is not essential for some purposes, but in this application it is frequently a desirable process. The carbon dioxide may be recovered from the scrubber liquid, e.g., the amine, and transported via line 17 to be comingled with the injected oxygen and steam and introduced back into the formation via injection well 2. The scrubbed produced gas exiting from the amine scrubber 16 passes through line 18, which may connect with a gathering system if the produced gas is to be utilized as a fuel gas, or into additional processing equipment depending on the manufacturing use to be made of the gases.

In the embodiment illustrated, the option is provided for passing the carbon monoxide and hydrogen into a methanizer 19, wherein the following reaction occurs:

$$3\,H_2 + CO \rightarrow CH_4 + H_2O$$

This conversion of hydrogen and carbon monoxide into methane occurs at temperatures above 500° F. in the presence of a nickel catalyst. This is a particularly desirable reaction to perform if it is desired to utilize the produced gases as fuel, since the BTU content of methane is more than three times the BTU content of either carbon monoxide or hydrogen, and so methane is a more preferred fuel. In some applications it is satisfactory to convert only a portion of the carbon monoxide in the methane, and enrich the carbon monoxide-hydrogen mixture with methane so as to increase its BTU content to some predetermined value. It should be realized, of course that additional hydrogen must be supplied as by line 20 to the methanation reaction for it to proceed since approximately 3 moles of hydrogen are utilized for each mole of carbon monoxide consumed.

From about 0.3 to about 1.2 pounds of oxygen per pound of hydrocarbon to be treated will ultimately be required, and the ratio of pounds of steam per pound of hydrocarbon material will be from about 0.25 to about 2.2.

The injection rate, e.g., the rate at which the steam and oxygen are injected into the formation, will ordinarily be a critical factor which must be controlled fairly closely. In order to maintain a reasonably constant linear volicity of the reaction front as it progresses outward from the injection well, it is preferable to gradually increase the injection rate with time. It is preferred that the initial oxygen injection rate be approximately 100 standard cubic feet of oxygen per foot of formation thickness per hour. This may be increased to about 300 after 5 days, and to an ultimate constant operating value of about 800 standard cubic feet per hour per foot of formation thickness after two weeks or more of oxygen injection. The steam injection rate may be keyed to the oxygen injection rate according to the ratios given above.

The process of my invention may be understood more clearly by reference to the following field example, which is offered only as an additional illustrative embodiment, and is not intended to be limitative or restrictive thereof.

A tar sand deposit is located under an overburden thickness of approximately 700 feet, and the thickness of the tar sand deposit is 125 feet. The injection well is located 200 feet from the production well. A boiler capable of producing super heated steam at a temperatue of around 800° F. and a pressure of 600 pounds per square inch is installed with the output connected to a mixing chamber for mixing with the oxygen enriched gas. An air fractionating plant is located near by, which separates air into oxygen and nitrogen. Essentially 98 percent pure oxygen is produced thereby, and this oxygen is heated to a temperature of500° F., mixed with a super heated steam, and injected into the injection wellbore. The injection pressure is maintained at 600 pounds per square inch. The production well is equipped with gauge for monitoring the pressure of the effluent gas being produced, and a throttling valve is installed to maintain the back pressure on the production well at a preselected value, 400 pounds per square inch in this instance. The output of the production well is fed to a heat exchanger so that heat from the produced effluent gases may be scavenged and utilized to generate steam for the operation.

At the start of the operation, essentially pure oxygen is injected without any steam into the formation and a 20,000 kilowatt electric heater is positioned in the injection wellbore adjacent the performations therein so as to heat that portion of the formation to a temperature adequate to initiate the combustion reaction. This heating operation continues for 36 hours, after which the heater is removed and the oxidation reaction is self sustaining. The oxygen injection rate during this ignition period is 12,500 standard cubic feet per hour. After ignition is established, heated oxygen and super heated steam are injected at a total injection rate of 15,000 standard cubic feet per hour. The weight ratio oxygen to steam is around 3.0 during the first week of operation. After one week of injection at this rate, the injection rate is increased to 90,000 standard cubic feet per hour and the ratio of oxygen to steam is decreased to 2.0. After an additional week of operating under these conditions, the injection rate is increased to 100,000 standard cubic feet per hour and the oxygen to steam weight ratio is reduced to 1.0 and maintained at this value during the continuation of the operation.

Gaseous effluents are obtained from the production well which are analyzed and found to be 42 percent carbon monoxide, 40 percent hydrogen, 5 percent methane, 2 percent water, and approximately 5 percent liquid hydrocarbons. The balance is essentially all carbon dioxide, and carbon dioxide is removed from the effluent gas by means of diethanolamine scrubbing. The carbon dioxide removed by this method is comingled with the injected oxygen and steam. The carbon monoxide and hydrogen are further treated to remove water and particulate matter, and then the carbon monoxide is separated from the hydrogen stream by refrigeration liquefication. The hydrogen is utilized in an ammonium manufacturing plant for hydrogenating nitrogen from the air separation plant.

Thus, I have disclosed that essentially solid hydrocarbon materials such as the carbon residue on sand grains in a tar sand deposit after completion of a controlled oxidation petroleum recovery operation can be converted into a gaseous mixture of carbon monoxide and hydrogen which can be utilized as fuel or manufacturing feed stocks by contacting the solid carbon residue with a mixture of water, carbon dioxide or super heated steam and an oxygen enriched gas at a critical ratio. While my invention has been described in terms of a number of specific illustrative embodiments it is not so limited, as many variations thereof will be apparent to persons skilled in the related art. Similarly, while a mechanism and reactions to describe the phenomena occurring upon application of the process of my invention to a subterranean solid hydrocarbon containing formation have been given, it is not necessarily represented hereby that this is the only mechanism or reactions occurring therein. It is my intention that my invention be limited and restricted only by those limitations and restrictions as appear in the appended claims.

I claim:

1. A method of recovering hydrocarbons from a subterranean porous, permeable viscous petroleum containing earth formation, comprising:

a. introducing a mixture of air and steam into the formation to initiate a low temperature, controlled oxidation reaction, which low temperature, controlled oxidation reaction results in recovering a portion of the hydrocarbon from the formation and leaving a solid, coke like residue on the formation mineral matrix;

b. thereafter introducing a gas which is at least 40% oxygen into the formation at a temperature of at least 600° F and a pressure of at least 200 lbs. per square inch;

c. introducing a moderating fluid selecting from a group consisting of water, superheated steam, saturated steam, and carbon dioxide, to comingle with the gas so that partial oxidation of the solid carbon material to the carbon monoxide and hydrogen occurs in the formation; and d. recovering the carbon monoxide and hydrogen from the subterranean formation.

2. A method as recited in claim 1 wherein the oxygen content of the oxygen enriched gas is above 90 percent.

3. A method as recited in claim 1 wherein the moderating fluid is water.

4. A method as recited in claim 1 wherein the moderating fluid is steam.

5. A method as recited in claim 1 wherein the moderating fluid is superheated steam.

6. A method as recited in claim 1 wherein the moderating fluid is carbon dioxide.

7. A method as recited in claim 1 wherein the weight ratio of oxygen to steam varies from 0.2 to 3.0.

8. A method as recited in claim 1 wherein the weight ratio of oxygen to steam introduced into the formation is decreased with injection of oxygen and steam into the formation.

9. A method as recited in claim 1 wherein carbon dioxide is also present in the produced gas and is separated from the produced gas on the surface and mixed with oxygen being introduced into the formation.

10. A method as recited in claim 1 wherein the formation being treated is a subterranean tar sand formation which has previously been subjected to treatment with air and saturated steam to cause a low temperature oxidation reaction to stimulate production of liquid petroleum, resulting in deposition of a coke like material on the formation sand grains.

11. A method of recovering viscous, bituminous petroleum from a subterranean tar sand deposit comprising:

a. introducing a mixture of air and steam into the formation at a predetermined ratio for the purpose of initiating a low temperature controlled oxidation reaction which propagates from the injection well toward the production well and recovering petroleum from the production well, which low temperature oxidation results in the formation of a solid, coke-like material on the formation sand grains;

b. thereafter introducing a gas which is at least 40% oxygen into the formation at a temperature of at least 600° F and at a pressure of at least 200 pounds per square inch;

c. introducing a moderating fluid selected from the group consisting of water, superheated steam, saturated steam, carbon dioxide, and mixtures thereof to comingle with the gas causing conversion of the coke-like material to a combustible gas comprising carbon monoxide and hydrogen in the formation; and d. recovering the combustible gas from the subterranean formation via the producing well.

12. A method as recited in claim 11 wherein the moderating fluid is saturated steam.

13. A method as recited in claim 11 wherein the moderating fluid is water.

14. A method as recited in claim 11 wherein the moderating fluid is superheated steam.

15. A method as recited in claim 11 wherein the moderating fluid is carbon dioxide.

16. A method as recited in claim 11 wherein the gas is oxygen-enriched air.

* * * * *